US008646509B2

(12) United States Patent
Chu

(10) Patent No.: US 8,646,509 B2
(45) Date of Patent: Feb. 11, 2014

(54) BLIND WITH LOOPED BLIND SHEET FOR ADJUSTING OPACITY

(76) Inventor: Chen-Ho Chu, Taipei (TW)

( * ) Notice: Subject to any disclaimer, the term of this patent is extended or adjusted under 35 U.S.C. 154(b) by 0 days.

(21) Appl. No.: 13/172,624

(22) Filed: Jun. 29, 2011

(65) Prior Publication Data

US 2012/0000617 A1 Jan. 5, 2012

(30) Foreign Application Priority Data

Jul. 1, 2010 (TW) ..... 99121755 A

(51) Int. Cl.
*A47H 23/06* (2006.01)

(52) U.S. Cl.
USPC ..... 160/123; 160/86; 160/184; 160/237

(58) Field of Classification Search
USPC ..... 160/85, 86, 123, 120, 121.1, 330, 345, 160/184, 196.1, 185, 197, 237
See application file for complete search history.

(56) References Cited

U.S. PATENT DOCUMENTS

| | | | | | |
|---|---|---|---|---|---|
| 687,870 | A * | 12/1901 | Watkinson | 160/85 |
| 1,303,081 | A * | 5/1919 | Losee | 160/29 |
| 2,082,406 | A * | 6/1937 | Lloyd et al. | 454/196 |
| 2,142,822 | A * | 1/1939 | Moore | 160/120 |
| 2,280,358 | A * | 4/1942 | Tietig | 160/120 |
| 2,281,022 | A * | 4/1942 | Cavanaugh | 160/85 |
| 2,384,377 | A * | 9/1945 | Holstein | 160/85 |
| 3,911,991 | A * | 10/1975 | Malferrari | 160/202 |
| 5,109,910 | A * | 5/1992 | Tortorella et al. | 160/197 |
| 5,538,065 | A * | 7/1996 | G eraud | 160/85 |
| 6,189,592 | B1 * | 2/2001 | Domel | 160/85 |
| 7,174,940 | B2 * | 2/2007 | Nien | 160/120 |
| 7,207,371 | B2 * | 4/2007 | Hsu | 160/85 |
| 7,267,156 | B2 * | 9/2007 | Byeon | 160/121.1 |
| 7,293,596 | B2 * | 11/2007 | Nien | 160/89 |
| 7,438,115 | B2 * | 10/2008 | Bohlen | 160/238 |
| 7,806,160 | B2 * | 10/2010 | Byeon | 160/85 |
| 2009/0229768 | A1 * | 9/2009 | Cheng | 160/237 |

FOREIGN PATENT DOCUMENTS

| | | | | |
|---|---|---|---|---|
| GB | 2253000 | * | 8/1992 | E06B 9/24 |
| JP | 1995-189573 | | 7/1995 | |

* cited by examiner

*Primary Examiner* — David Purol
(74) *Attorney, Agent, or Firm* — Muncy, Geissler, Olds & Lowe, PLLC

(57) ABSTRACT

A blind with a looped blind sheet for adjusting opacity is revealed. The blind includes a top rod supporter, a top rod with two ends connected to the top rod supporter, a bottom rod supporter, a bottom rod with two ends connected to the bottom rod supporter, and looped blind sheet. The looped blind sheet with predetermined length and width includes alternate see-through parts and opaque parts and connected to form a loop having a front blind sheet and a rear blind sheet wound between the top rod and the bottom rod. When the front blind sheet or the rear blind sheet is pulled down or up, the opacity is adjusted by overlap degree of the see-through parts and the opaque parts of the front and the rear blind sheets changing without changing the length of the looped blind sheet.

13 Claims, 16 Drawing Sheets

BLIND WITH LOOPED BLIND SHEET FOR ADJUSTING OPACITY

BACKGROUND OF THE INVENTION

1. Field of the Invention

The present invention relates to a blind with a looped blind sheet for adjusting opacity, especially to a blind with a looped blind sheet including alternate see-through parts and opaque parts. The looped blind sheet is wound between a top rod and a bottom rod to form a front blind sheet and a rear blind sheet. The front and the rear blinds sheets are opposed each other and stretched tightly. The opacity of the blind is adjusted by pulling the front blind sheet or the rear blind sheet.

2. Description of Related Art

Refer to Japanese Patent Publication No. 1995-189573, U.S. Pat. No. 6,189,592, and U.S. Pat. No. 7,267,156, conventional blinds have been disclosed. Blind sheets with alternate transparent and opaque parts with a predetermined width are folded to form a front blind sheet and a rear blind sheet. The blinds revealed in these patents are all roller shades whose blind sheet includes a rolling end. The overlap degree of the transparent and opaque parts between the front blind sheet and the rear blind sheet are adjusted by relative movement of the font blind sheet or the rear blind sheet (only the blind sheet connected with the rolling end moved up or down). And the length of the blind sheet is changed. Moreover, the distance between the front blind sheet and the rear blind sheet should be larger in consideration of the radial thickness of the blind sheet folded around a winding rod, as the winding rod 114 revealed in U.S. Pat. No. 7,267,156. Thus the opacity of the blind is difficult to be adjusted optimally due to this larger distance. Furthermore, the structure of the roller-shade type blind is more complicated than the structure of a blind of the present invention. For example, two ends of the blind sheet are respectively fixed on a winding rod (such as winding rod 114 in U.S. Pat. No. 7,267,156) inside a top supporter, and a fixing rod (such as upper-end support bar 111 in U.S. Pat. No. 7,267,156). And a lifting member (such as adjusting cord/lift mechanism 116 in U.S. Pat. No. 7,267,156) is required to wind up or pull down the blind sheet.

A sliding panel is a kind of a blind. Take a sliding panel 2 shown in FIG. 1 as an example, it includes a rail 201, a plurality of carrier tracks 202 (there is only one carrier track in FIG. 1) arranged under the rail 201, a plurality of panels 203 attached each other and disposed under the carrier track 202, two separate connectors 204 arranged at a top surface of each carrier track 202, and a runner 205 such as a pulley connected to and disposed over each connector 204. By the connector 204 penetrating a channel opening 207 of a channel 206 on bottom of the rail 201, the runner 205 slides inside the channel 206 of the rail 201 so that each carrier track 202 and the corresponding panel 203 slides and extends gradually for shading windows, or folds and overlaps with one another so that the windows are in the see-through state. The panel (no shown in figure, replaced by a blind 1) generally is formed by a blind sheet with preset length (height). Although the blind sheet can be made from various materials, the opacity each panel formed by the blind sheet is constant and unable to be adjusted.

Curtains are also a kind of blind. Take a curtain 3 shown in FIG. 10 as an example. The curtain 3 consists of one rail 301 with at least one blind sheet 302, at least one hook 303 and a curtain rod 304 over a window. The blind sheet 302 is hooked on the curtain rod 304 by the hook 303. The blind sheet 302 (not shown in figure, replaced by a blind 1) is also formed by a piece of fabric with preset length (height). There are various types of fabric with different opacities used to produce the blind sheet 302. Yet the opacity of the blind sheet 302 while already used is still unable to be changed. That means the opacity of the blind sheet 302 is determined. It will keep the same opacity all the time.

SUMMARY OF THE INVENTION

Therefore it is a primary object of the present invention to provide a blind with a looped blind sheet for adjusting opacity that is used as a panel of a sliding panel or as a curtain hung on a curtain rod. The blind features on simplified structure and adjustable opacity.

In order to achieve the above object, a blind with a looped blind sheet of the present invention includes a top rod supporter formed a carrier track of a sliding panel or being hooked on a curtain rod, a top rod with two ends connected to the top rod supporter, a bottom rod supporter, a bottom rod with two ends connected to the bottom rod supporter, and a looped blind sheet with predetermined length and width. The looped blind sheet includes alternate see-through parts and opaque parts connected to form a loop. The loop is wound between the top rod and the bottom rod to form a front blind sheet, and a rear blind sheet, opposed each other. The front and the rear blind sheets are stretched tightly by the weight of the bottom rod and the bottom rod supporter. While the front blind sheet or the rear blind sheet being pulled down or up, the overlap degree of the see-through parts and opaque parts between the front blind sheet and the rear blind sheet is changed by synchronous relative movement of the front and the rear blind sheets without changing length of the blind. For example, the opaque parts of the front blind sheet are corresponding to and overlapped with the see-through parts of the rear blind sheet so as to form a shade state. That means the opaque parts of the front blind sheet shades the see-through parts of the rear blind sheet. Or the see-through parts of the front blind sheet are corresponding to and overlapped with the see-through parts of the rear blind sheet (the see-through parts of the rear blind sheet are not shaded by the opaque parts of the front blind sheet) to form a see-through state.

It is another object of the present invention to provide a blind with a looped blind sheet for adjusting opacity in which the left and right ends of the top rod are rotatably connected with the top rod supporter. Thus the smoothness of the looped blind sheet during winding and moving around the top rod is improved.

It is a further object of the present invention to provide a blind with a looped blind sheet for adjusting opacity in which the left and right ends of the bottom rod are rotatably connected with the bottom rod supporter. Thus the winding and moving of the looped blind sheet around the bottom rod are more smooth.

It is a further object of the present invention to provide a blind with a looped blind sheet for adjusting opacity in which a small loop with certain length is formed on a bight of the looped blind sheet around the top rod (or the bottom rod). The small loop is produced by double layer of a small portion of the looped blind sheet and including a front termination and a rear termination. The top rod (or the bottom rod) passes through the small loop so as to limit the relative motion of the front and the rear blind sheets during the opacity adjustment process and prevent the looped blind sheet from being abraded or damaged by overturning or over movement between the top rod and the bottom rod. Moreover, the length of the small loop can be preset as a basic displacement unit of the front and the rear blind sheets while adjusting the opacity. When the top rod (or the bottom rod) is stopped at one termination (such as the front termination) of the small loop, the opaque parts of the front blind sheet correspond to and overlap with the see-through parts of the rear blind sheet so as to form the shade state. While the top rod (or the bottom rod) being stopped at the other termination of the small loop (the rear termination), the see-through parts of the front blind sheet correspond to and overlap with the see-through parts of the rear blind sheet so that the see-through state is formed. By pulling the front blind sheet or the rear blind sheet up or down a certain length (such as a basic displacement unit), the opacity adjustment of the blind is achieved.

It is a further object of the present invention to provide a blind with a looped blind sheet for adjusting opacity that further includes a front stop point and a rear stop point on a bight of the top rod (or the bottom rod). The front and the rear stop points are formed by a stop rib arranged on each of two positions of a front side and a rear side of the bight so as to limit the displacement of the front and the rear blind sheets being pulled for adjusting opacity and avoid abrasion/damages caused by overturning or movement of the looped blind sheet between the top rod and the bottom rod. Furthermore, the distance between the front and the rear stop points is set as one basic displacement unit of the front and the rear blind sheets for adjusting opacity. The see-through parts of the front blind sheet correspond to and overlap with the see-through parts of the rear blind sheet so as to be in the see-through state when the top rod (or the bottom rod) is stopped at one stop point (such as the front stop point). When the top rod (or the bottom rod) is stopped at the other stop point (such as the rear stop point), the opaque parts of the front blind sheet correspond to and overlap with the see-through parts of the rear blind sheet so that the blind is in the shade state. Thus the blind opacity is adjusted by the front blind sheet or the rear blind sheet being pulled up or down a certain distance (one basic displacement unit).

It is a further object of the present invention to provide a blind with a looped blind sheet for adjusting opacity that is arranged with a panel under the bottom rod supporter or above the top rod supporter so as to form a complex blind. The lower part of the bottom rod supporter extends to form a groove with an opening facing downward or the upper part of the top rod supporter extends to form a groove with an opening facing upward. The groove is used for mounting a non-looped blind sheet such as a panel to form a complex blind. The looped blind sheet is a part of the complex blind. Thus the length of the blind can be extended upwards or downward. Therefore, the length of the blind with a looped blind sheet of the present invention can be adjusted according to the height of the doors/windows or used in combination with rails of general sliding panels easily to form the complex blind.

DETAILED DESCRIPTION OF THE PREFERRED EMBODIMENT

The First Embodiment

Figure 1:
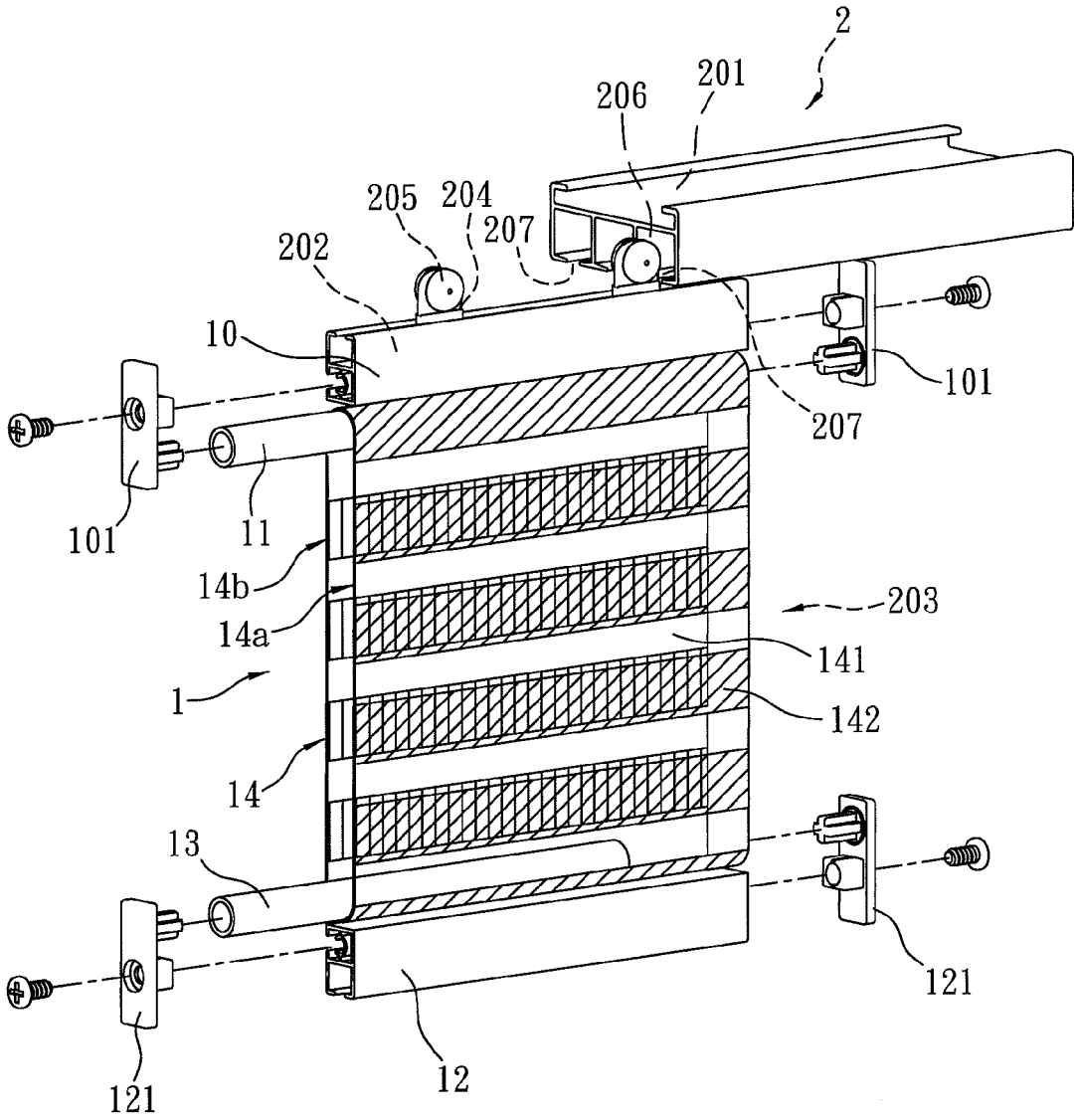
FIG. 1 is an explosive perspective view of an embodiment in a see-through state according to the present invention.

Refer from FIG. 1 to FIG. 4, a blind 1 with a looped blind sheet for adjusting opacity is used as a panel 201 of a sliding panel 2. The blind 1 with a looped blind sheet for adjusting opacity of the present invention mainly includes a top rod supporter 10, a top rod 11, a bottom rod supporter 12, a bottom rod 13 and a looped blind sheet 14.

In this embodiment, the top rod supporter 10 is, but not limited to, an integrated, aluminum extrusion fabricated part in a form of a carrier track 202 of the sliding panel. The length of the top rod supporter 10 is not restricted and a base 101 is assembled on each of two ends thereof.

Figure 2:
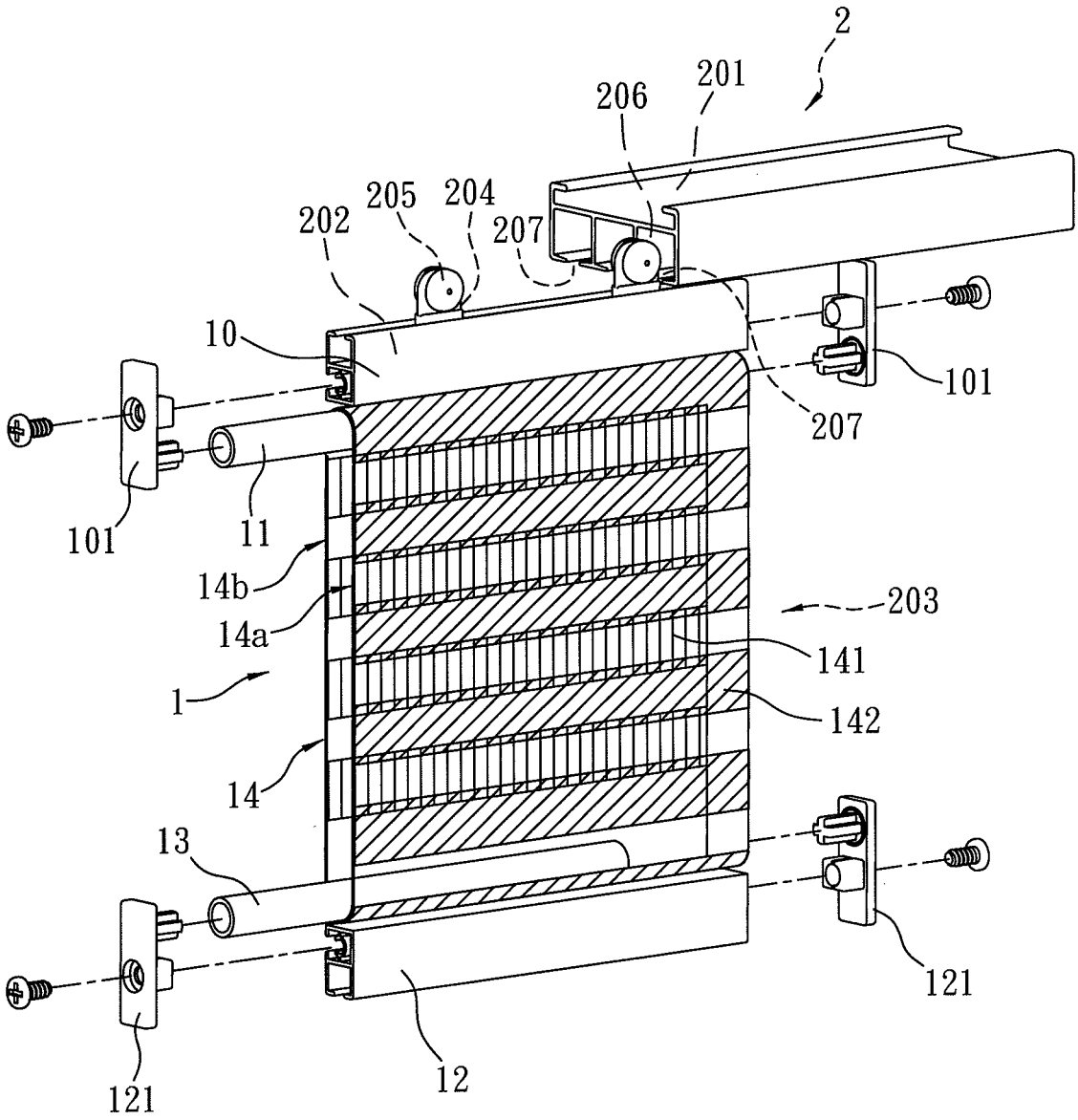
FIG. 2 is an explosive view of an embodiment in a shade state according to the present invention.
Figure 2A:
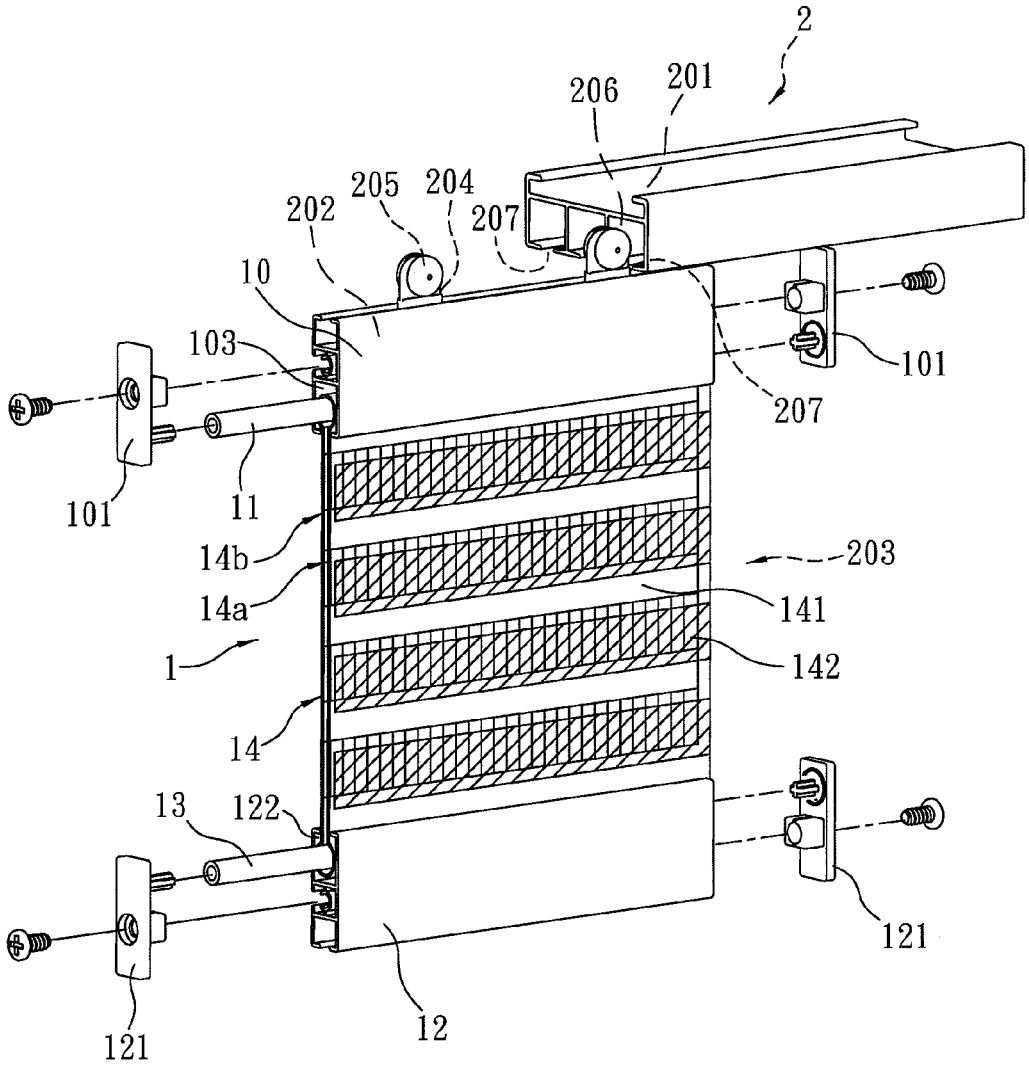
FIG. 2A is another explosive view of an embodiment in which a top rod and a bottom rod are respectively mounted on a top rod supporter and a bottom rod supporter according to the present invention.
Figure 4:
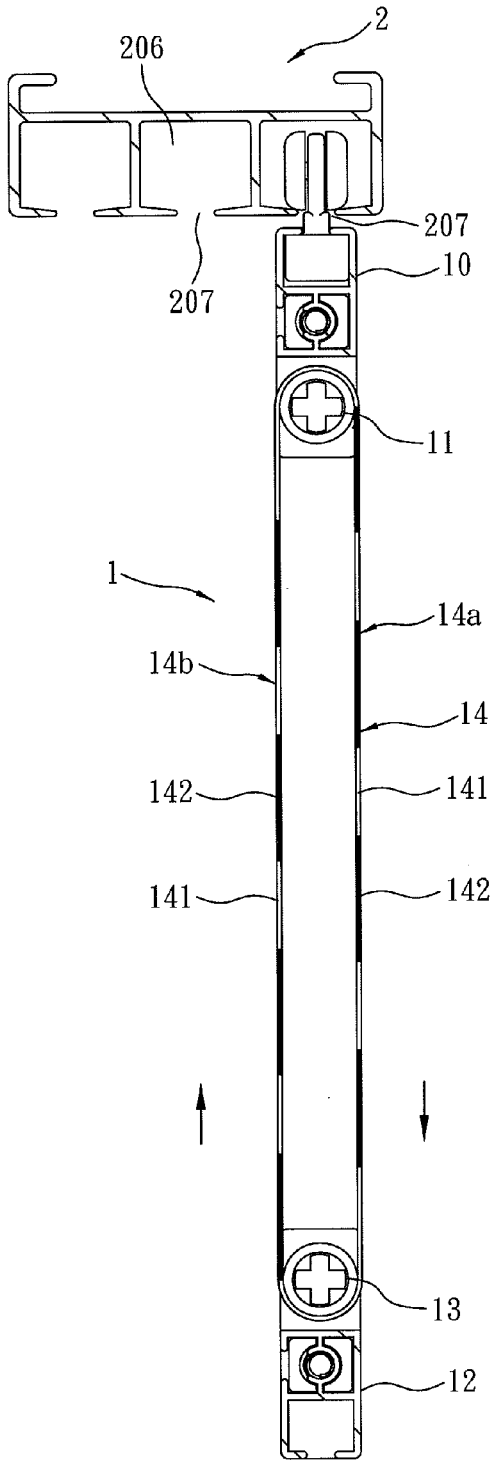
FIG. 4 is a cross sectional view of the embodiment in FIG. 2 according to the present invention.
Figure 4A:
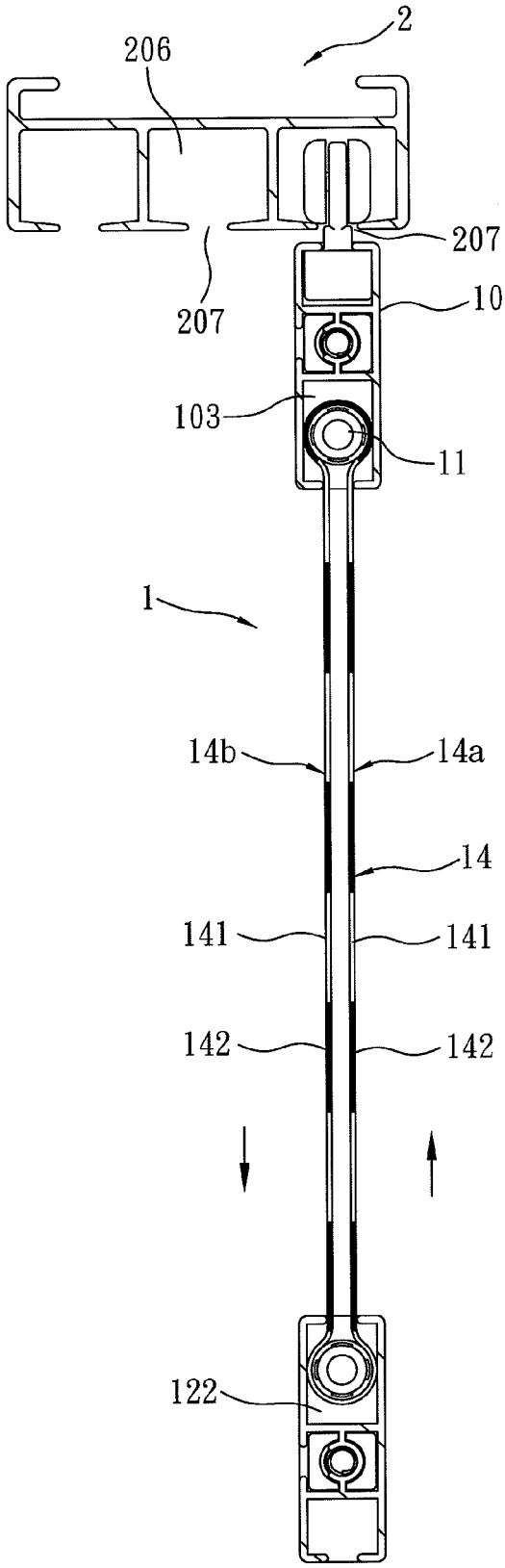
FIG. 4A is a cross sectional view of the embodiment in FIG. 2A according to the present invention.

The right and left ends of the top rod 11 are connected with the top rod supporter 10 so that the looped blind sheet 14 is wound around the top rod 11. In this embodiment, the top rod 11 is a round bar whose left and right ends are fixed and sleeved between the two bases 101. The fixing way of the two ends of the top rod 11 is not limited. The assembling way between the top rod 11 and the top rod support 10 is not limited. For example, the top rod 11 is rotatably connected to the top rod supporter 10 so that a friction between the looped blind sheet 14 and the top rod 11 is reduced and the looped blind sheet 14 is wound and moved more smoothly. Moreover, the top rod 11 in this embodiment is arranged at the bottom of the top rod supporter 10, but not limited to. The bottom of the top rod supporter 10 extends to form a C-shaped groove 103 with an opening facing downward, as shown in FIG. 2A and FIG. 4A so that the top rod 11 is mounted in the C-shaped groove 103 while the looped blind sheet 14 passing the downward opening of the C-shaped groove 103 is wound around the top rod 11.

The shape of the bottom rod supporter 12 is not limited. In this embodiment, the bottom rod supporter 12 is (but not limited to) an integrated, aluminum extrusion fabricated part whose length is corresponding to the top rod supporter 10. Each of two ends of the bottom rod supporter 12 is sleeved with a base 121.

The left and right ends of the bottom rod 13 are connected with the bottom rod supporter 12 and the looped blind sheet 14 is wound around part of the bottom rod 13. In this embodiment, the bottom rod 13 is a round bar whose left and right ends are fixed and sleeved between the two bases 121 on two ends of the bottom rod supporter 12. The assembling way between the bottom rod 13 and the bottom rod support 12 is not limited. For example, the bottom rod 13 is rotatably connected with the bottom rod supporter 12 so that a friction between the looped blind sheet 14 and the bottom rod 13 is reduced and the looped blind sheet 14 is wound and moved more smoothly. Moreover, the bottom rod 13 in this embodiment is arranged at the top of the bottom rod supporter 12, but not limited to. The upper part of the bottom rod supporter 12 extends to form a C-shaped groove 122 with an opening facing upward, as shown in FIG. 2A and FIG. 4A so that the bottom rod 13 is mounted in the C-shaped groove 122 while the looped blind sheet 14 passing the upward opening of the C-shaped groove 122 is wound around the bottom rod 13. In this embodiment, the bottom rod supporter 12 and the bottom rod 13 can be arranged, but not limited, correspondingly to the top rod support 10 and the top rod 11 respectively in a symmetrical way.

Figure 3:
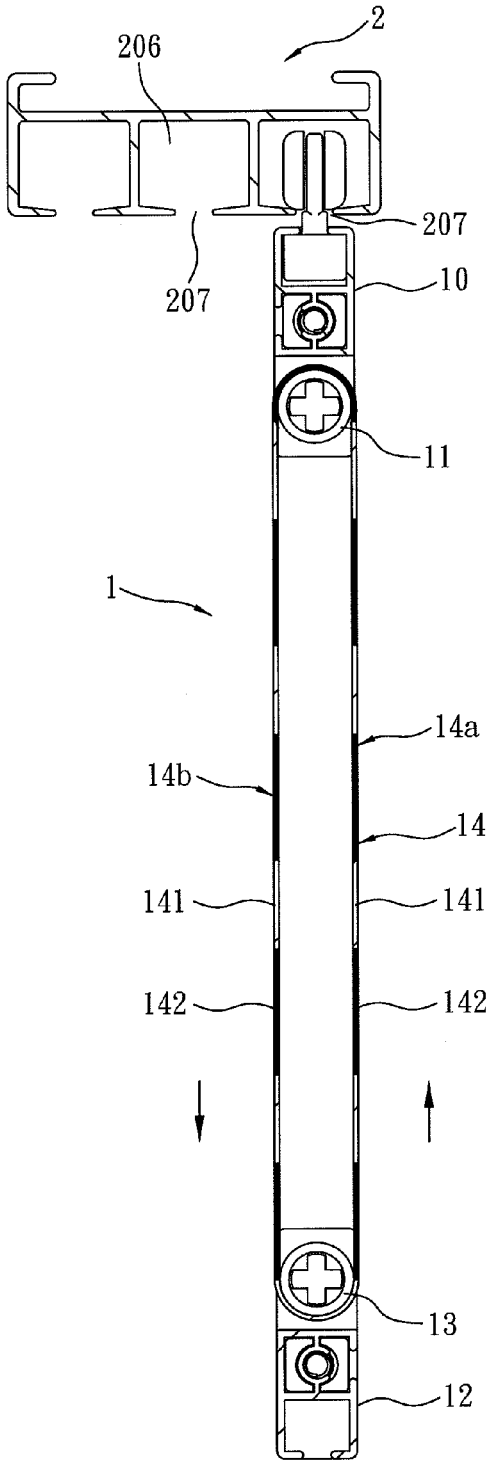
FIG. 3 is a cross sectional view of the embodiment in FIG. 1 according to the present invention.

The looped blind sheet 14 with predetermined length and width includes see-through parts 141 and opaque parts 142 arranged in an alternate manner and connected to form a loop that is wound between the top rod 11 and the bottom rod 13. Thus a front blind sheet 14*a* and a rear blind sheet 14*b* opposed to each other are formed and are stretched tightly by the weight of the bottom rod 13 and the bottom rod supporter 12. Refer to FIG. 3 and FIG. 4, when the front blind sheet 14*a* or the rear blind sheet 14*b* is pulled down or up as arrows indicate, the opacity of the looped blind sheet 14 is adjusted by synchronous movement and relative motion of the front and the rear blind sheets 14*a*, 14*b* without changing the length of the looped blind sheet 14. Once the front blind sheet 14*a* is pulled up, the rear blind sheet 14*b* is moved down synchronously. By adjusting overlap degree of the see-through parts 141 and the opaque parts 142 of the front and the rear blind sheets 14*a*, 14*b*, a shade state or a see-through state is generated. As shown in FIG. 2 and FIG. 4, the shade state is shown by the opaque parts 142 of the front blind sheet 14*a* are corresponding to and overlapped with the see-through parts 141 of the rear blind sheet 14*b*. That means the opaque parts 142 of the front blind sheet 14*a* shades the see-through parts 141 of the rear blind sheet 14*b*. Or the see-through parts 141 of the front blind sheet 14*a* are corresponding to and overlapped with the see-through parts 141 of the rear blind sheet 14*b* while the see-through parts 141 of the rear blind sheet 14*b* are not shaded by the opaque parts 142 of the front blind sheet 14*a*. Thus the see-through state is formed, as shown in FIG. 1 and FIG. 3. Therefore, the structure of the blinds is simplified and the opacity of the blinds is adjusted easily.

In this embodiment, the looped blind sheet 14 includes, but not limited to, alternate see-through parts 141 and opaque parts 142. The alternate parts can be formed by different patterns. As to the opacity, the width (vertical height) of the opaque part 142 is designed to be larger than the width of the see-through part 141 so as to achieve better shading effect.

Moreover, the so-called "looped" of the looped blind sheet 14 means the form or the connection way thereof. The looped blind sheet 14 is formed by a stripe of blind sheet whose two ends are connected with each other. Or around a bight of the top rod 11 (or the bottom rod 13), blind sheets made from different materials are connected in various ways (without affecting the appearance of the looped blind sheet 14). The front and the rear blind sheets 14*a*, 14*b* are moved synchronously under the condition that the total length of the blind remains the same. The looped blind sheet 14 of the present invention has the following two features. Firstly, when the front blind sheet 14*a* or the rear blind sheet 14*b* is pulled up or pulled down, the total length of the blind remains unchanged. The other feature is that the front and the rear blind sheets 14*a*, 14*b* are moved "synchronously", relative to each other.

Figure 5:
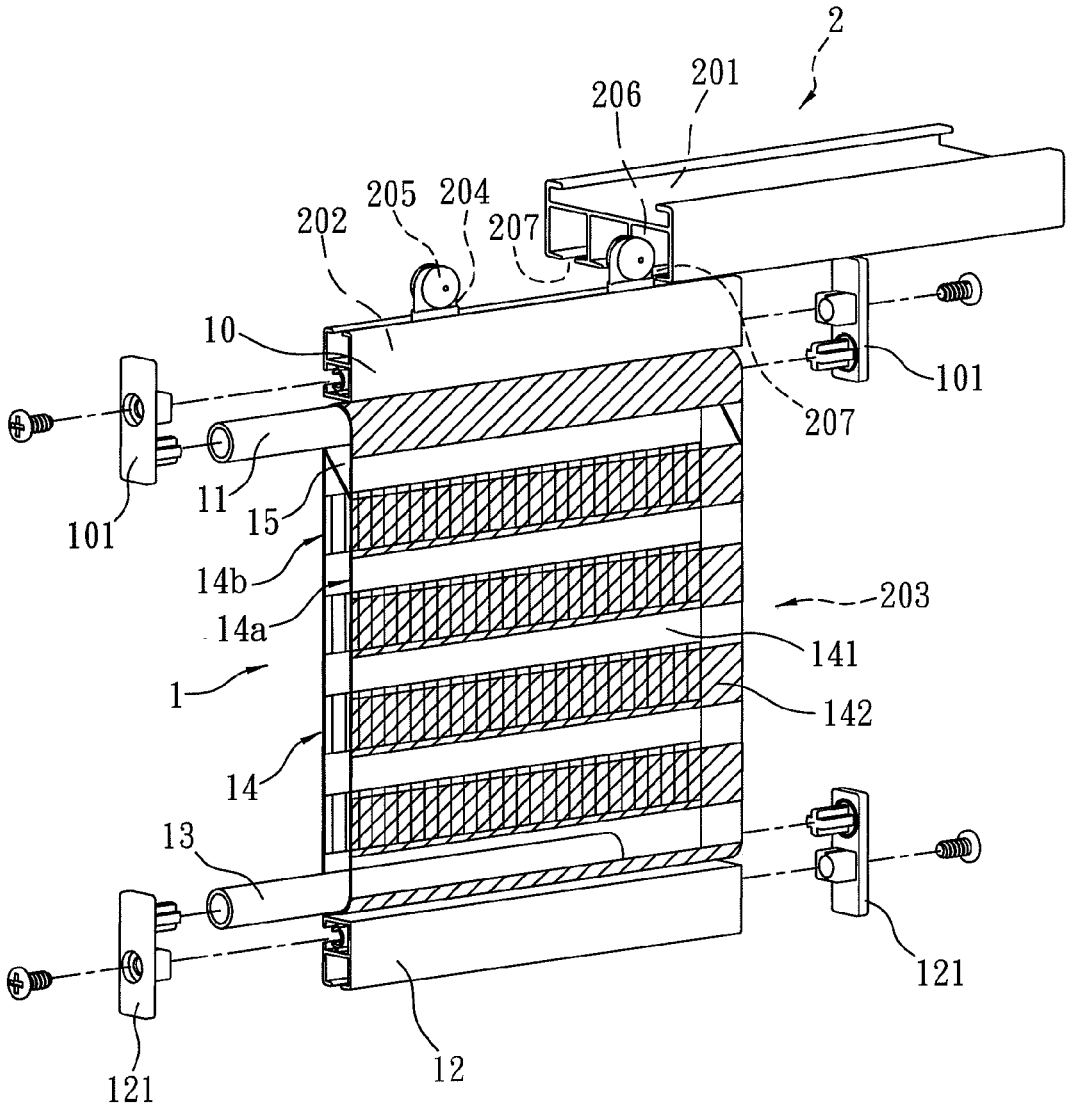
FIG. 5 is a schematic drawing showing another embodiment of the present invention in using state.
Figure 6:
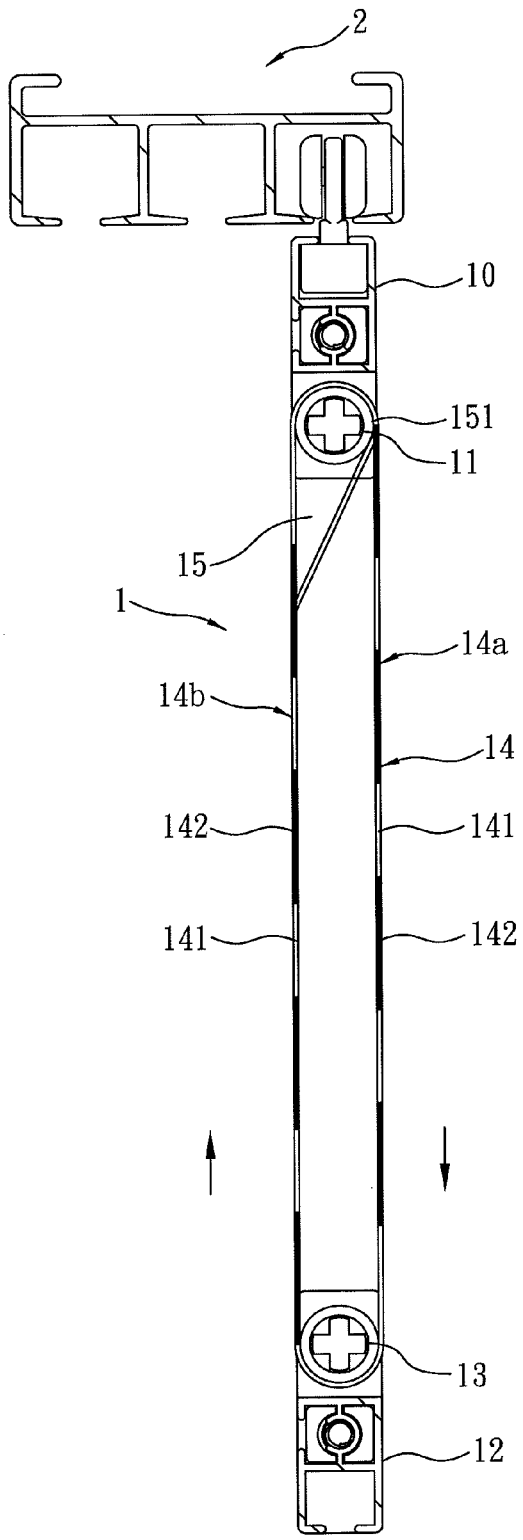
FIG. 6 is a cross sectional view of the embodiment in a shade state in FIG. 5 according to the present invention.
Figure 7:
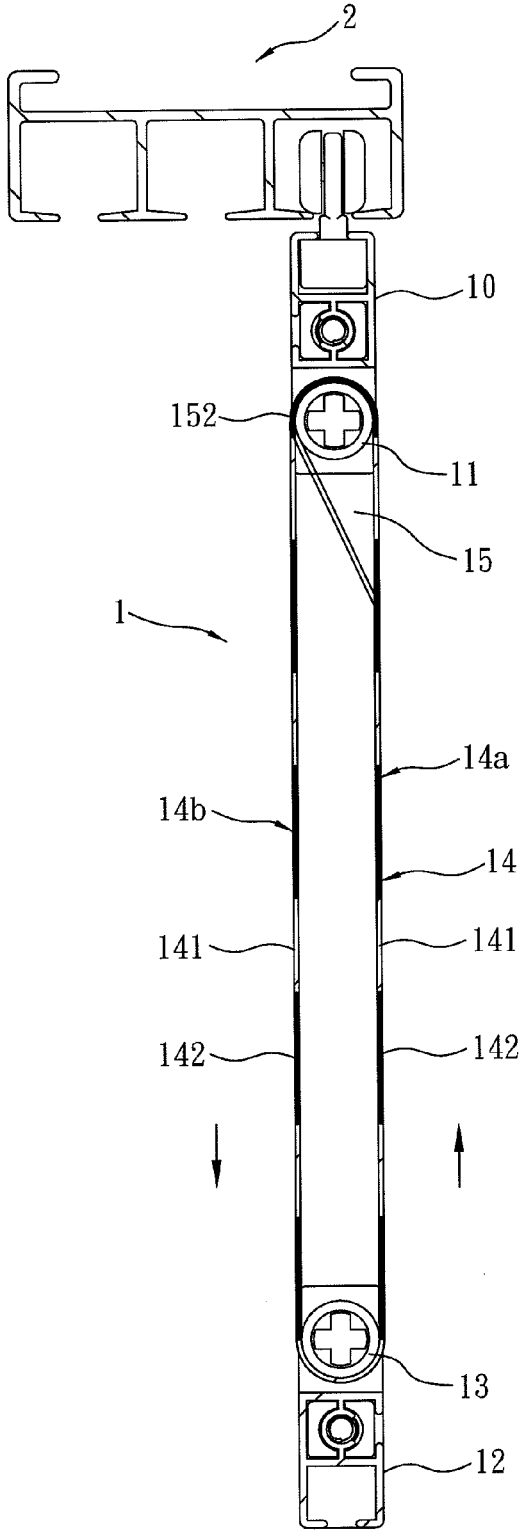
FIG. 7 is a cross sectional view on the other side of an embodiment in a see-through state in FIG. 6 according to the present invention.

Refer from FIG. 5 to FIG. 7, a small loop 15 with certain length is formed on a bight of the looped blind sheet 14 around the top rod 11 (or the bottom rod 13). The small loop 15 is produced by double layer of a small portion of the looped blind sheet 14 and is having a front termination 151 as well as a rear termination 152. The front and rear termination 151, 152 represent the connections between the double layers of the small portion and the original single layer blind sheet 14. Moreover, the top rod 11 (or the bottom rod 13) passes through inside the small loop 15 so as to limit the relative motion of the front and the rear blind sheets 14*a*, 14*b* during the opacity adjustment process and prevent the looped blind sheet 14 from being abraded or damaged by overturning or over movement between the top rod 11 and the bottom rod 13. While designing the length of the small loop 15, the length of the small loop 15 can be set as a basic displacement unit of the front and the rear blind sheets 14*a*, 14*b* during the opacity adjustment. Thus when the top rod 11 (or the bottom rod 13) is stopped at the front termination 151 of the small loop 15, as shown in FIG. 6, the opaque parts 142 of the front blind sheet 14*a* correspond to and overlap with the see-through parts 141 of the rear blind sheet 14*b* so as to form the shade state. Refer to FIG. 7, when the top rod 11 (or the bottom rod 13) is stopped at the rear termination 152 of the small loop 15, the see-through parts 141 of the front blind sheet 14*a* correspond to and overlap with the see-through parts 141 of the rear blind sheet 14*b* so as to be in the see-through state. By pulling the front blind sheet 14*a* and the rear blind sheet 14*b* up or down a certain length (such as a basic displacement unit), the opacity of the blind 1 is adjusted.

Figure 8:
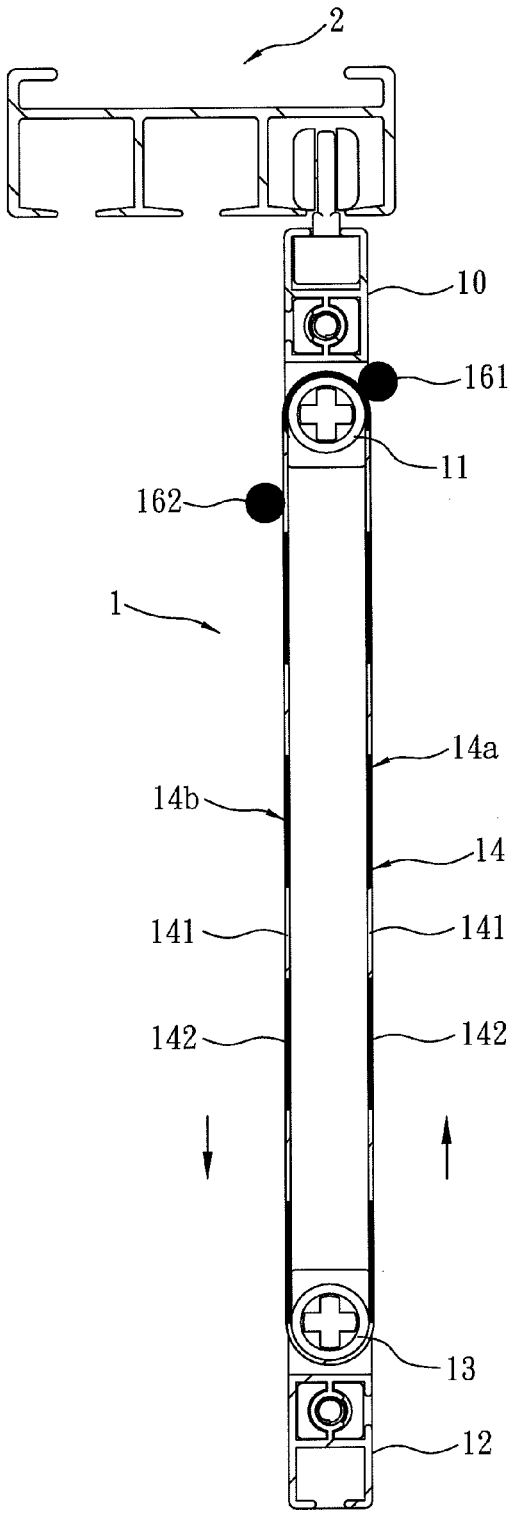
FIG. 8 is a cross sectional view of the embodiment in FIG. 1 in using and see-through state according to the present invention.
Figure 9:
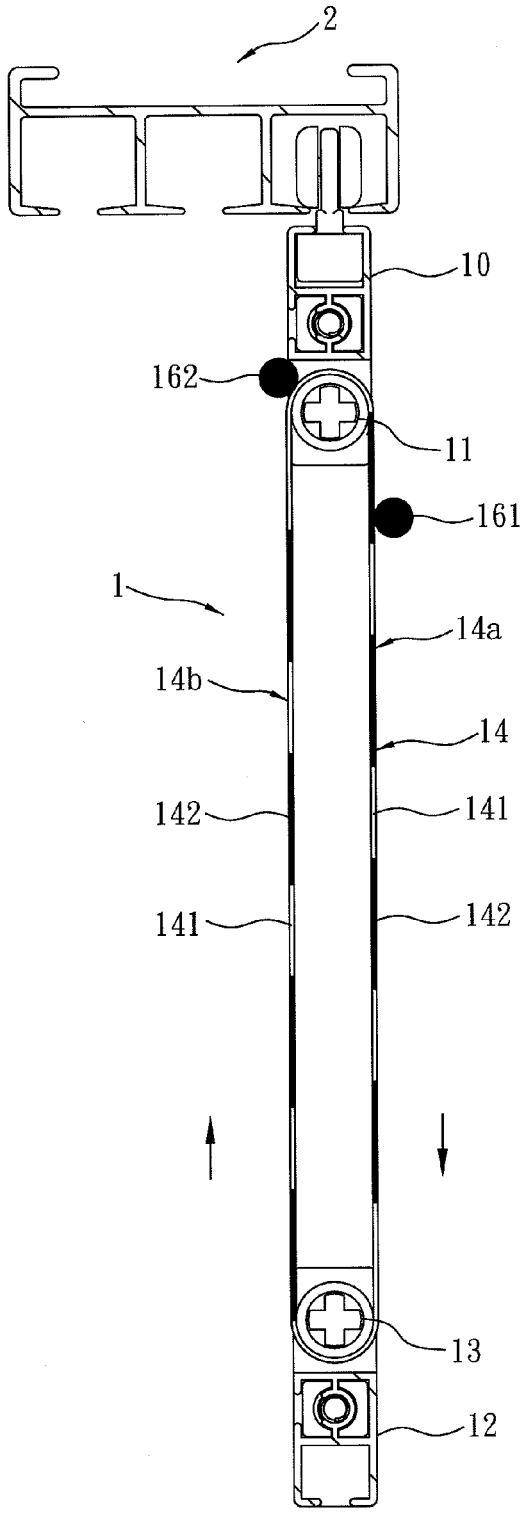
FIG. 9 is a cross sectional view on the other side of the embodiment in FIG. 8 (shade state) according to the present invention.

Moreover, the design of the small loop 15, the front termination 151 and the rear termination 152 of the above embodiment is not limited. Other modifications of them can also achieve the same opacity adjustment by pulling the front and the rear blind sheets 14*a*, 14*b* to move certain displacement units. For example, refer to FIG. 8 and FIG. 9, the looped blind sheet 14 further includes a front stop point 161 and a rear stop point 162 on a bight of the top rod 11 (or the bottom rod 13). The front stop point 161 and the rear stop point 162 are formed by a stop rib arranged on each of two positions of a front side and a rear side of the bight so as to limit the displacement of the front and the rear blind sheets 14*a*, 14*b* being pulled for adjusting opacity and avoid abrasion/damages caused by overturning or over movement of the looped blind sheet 14 between the top rod 11 and the bottom rod 13. Furthermore, the distance between the front and the rear stop points 161, 162 is set as a basic displacement unit of the front and the rear blind sheets 14*a*, 14*b* for adjusting opacity. Thus as shown in FIG. 8, the see-through parts 141 of the front blind sheet 14*a* correspond to and overlap with the see-through parts 141 of the rear blind sheet 14*b* so as to be in the see-through state when the top rod 11 (or the bottom rod 13) is stopped at the front stop point 161. Refer to FIG. 9, when the top rod 11 (or the bottom rod 13) is stopped at the rear stop point 162, the opaque parts 142 of the front blind sheet 14*a* correspond to and overlap with the see-through parts 141 of the rear blind sheet 14*b* so as to be in the shade state. Once the front blind sheet 14*a* or the rear blind sheet 14*b* is pulled up or down a certain distance (one basic displacement unit), the blind opacity is changed and adjusted.

The Second Embodiment

Figure 10:
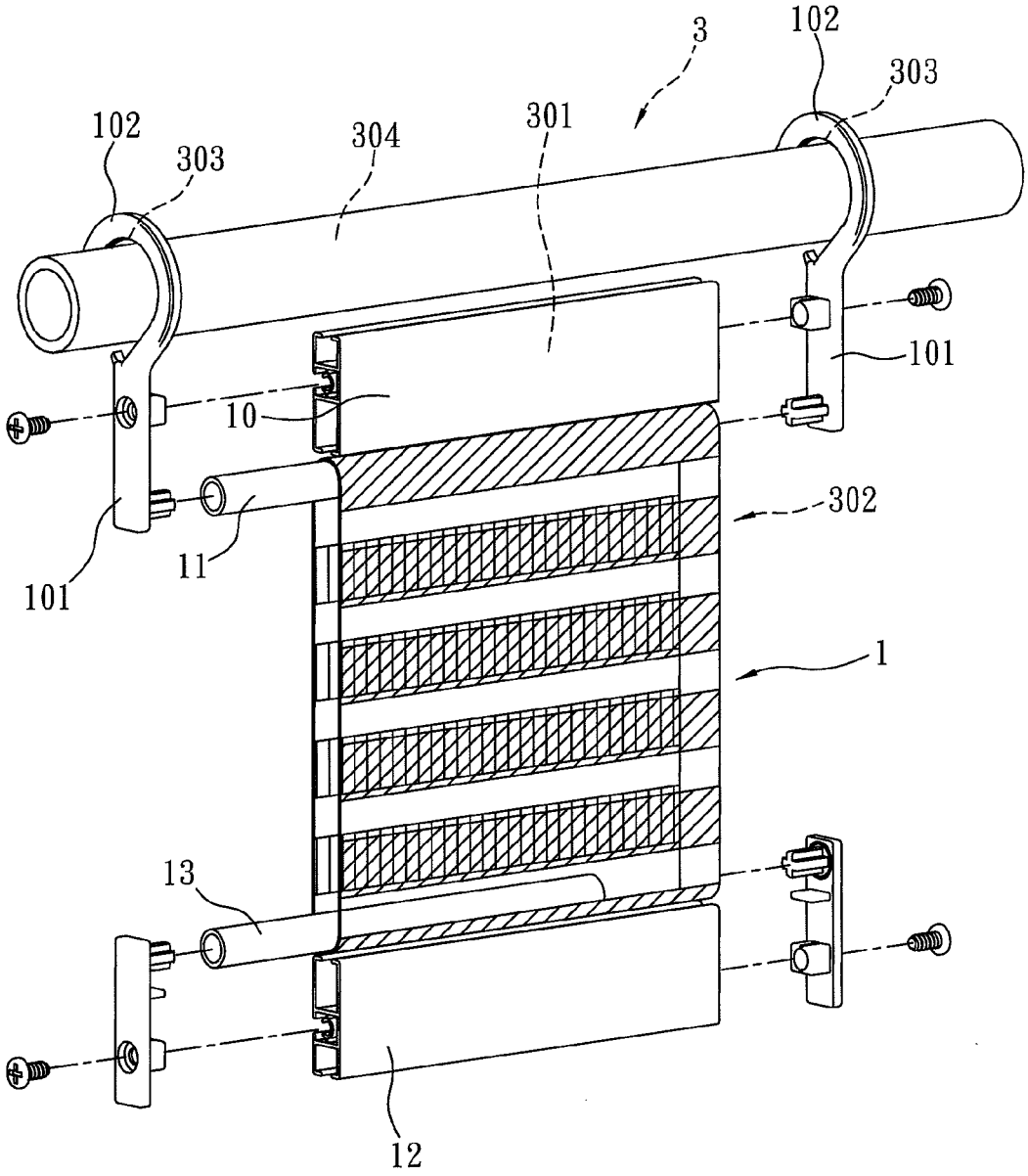
FIG. 10 is a perspective view of a further embodiment in a see-though state according to the present invention.
Figure 11:
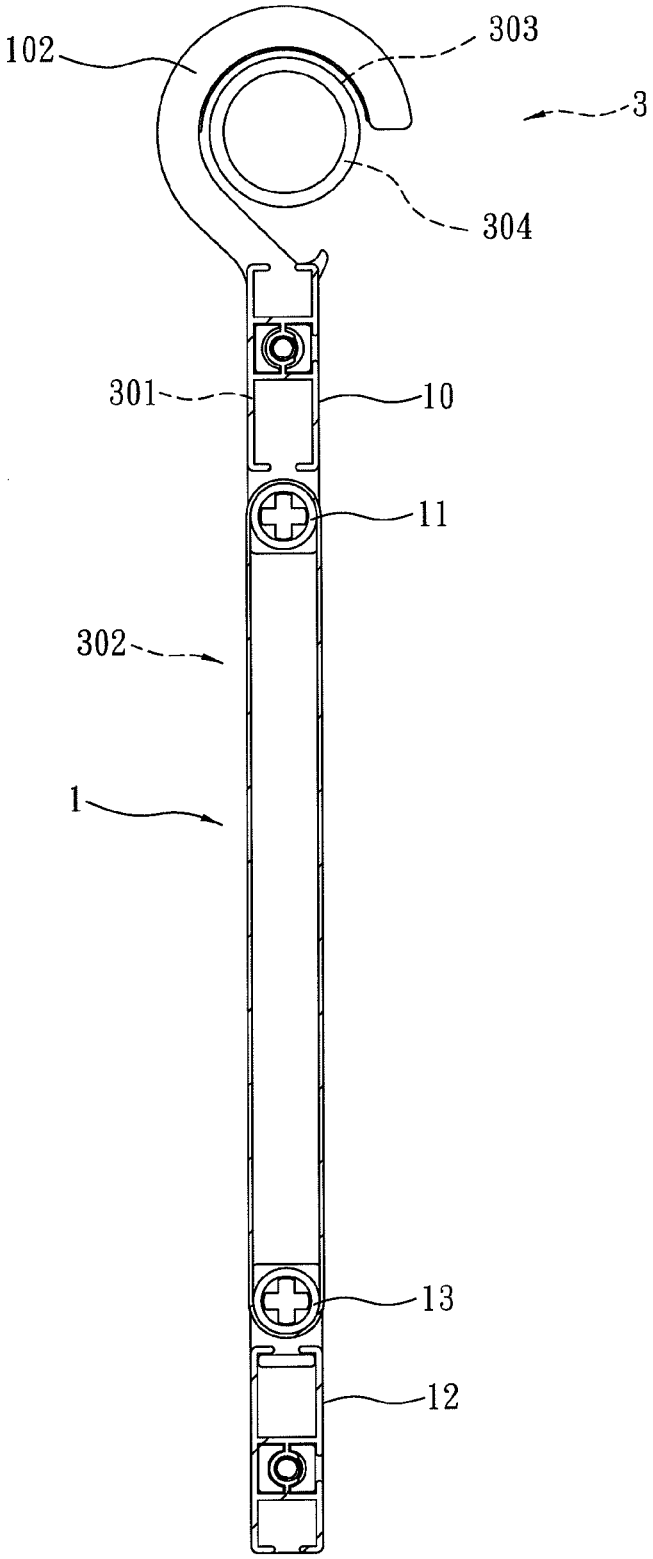
FIG. 11 is a cross sectional view of the embodiment in FIG. 10.

Refer to FIG. 10 and FIG. 11, an embodiment of a blind 1 with a looped blind sheet for adjusting opacity according to the present invention is hung on a curtain rod 304 and used as a curtain 3. In this embodiment, the blind 1 with a looped blind sheet for adjusting opacity is used as a panel 201 of a sliding panel 2. The blind 1 with a looped blind sheet for adjusting opacity of the present invention mainly includes a top rod supporter 10, a top rod 11, a bottom rod supporter 12, a bottom rod 13 and a looped blind sheet 14. The difference between this embodiment and the above one is in that the top rod supporter 10 is hooked onto the curtain rod 304 of a curtain by at least a hook 102. In this embodiment, the hook 12 is disposed on the base 101.

The shape of the top rod supporter 10 and of the bottom rod supporter 12 is not limited. It can be a carrier track of sliding panels or a part with hooks for being hung on the curtain rod. The assembling type and the size of the top rod supporter and of the bottom rod supporter 12 are also not restricted, depending on the applications and users' requirements. Moreover, an assembly of the bottom rod 13 with the bottom rod supporter 12 has a certain weight so that the front blind sheet 14*a* and the rear blind sheet 14*b* are stretched tightly by the weight of this assembly. While the front blind sheet 14*a* or the rear blind sheet 14*b* being pulled down or up for adjusting opacity of the blind, the weight helps the front blind sheet 14*a* and the rear blind sheet 14*b* remain flat even the blind being applied with a pull force. The weight also makes the front blind sheet 14*a* and the rear blind sheet 14*b* become located easily after pull.

Compared with prior arts, the present invention has following differences and advantages:

1. Prior arts disclosed in Japanese Patent Publication No. 1995-189, 573, U.S. Pat. No. 6,189,592, and U.S. Pat. No. 7,267,156 are all roller shades that adjusts overlap degree of transparent and opaque parts by the relative movement of the front blind sheet and the rear blind sheet. The whole blind is pulled up or down and its length is also changed. However, the blind sheet of the present invention is a looped blind sheet wound between a top rod and a bottom rod to form front and rear blind sheets, opposed each other and stretched tightly. Thus the length of the front and rear blind sheets remains unchanged while the front and rear blind sheets moved relatively for adjusting the overlap degree of see-through parts and opaque parts of the front and rear blind sheets.

2. In prior arts, the distance between the front blind sheet and the rear blind sheet is larger so that the opacity of the blind is difficult to be adjusted optimally while adjusting overlap degree of the see-through parts and opaque parts of the front and rear blind sheets. However, the blind sheet of the present invention is a looped blind sheet wound between a top rod and a bottom rod to form the front blind sheet and the rear blind sheet, opposed each other and stretched tightly. The top rod and the bottom rod can be slender rods while the blind sheet is not wound around the top rod and the bottom rod. Thus the overlap degree of the see-through and opaque parts of the front and rear blind sheets is adjusted by relative movement of the front and rear blind sheets. Therefore the opacity of the blind is adjusted to optimal condition.

3. The prior arts are roller shades including a blind sheet whose two ends are respectively fixed on a winding rod (such as winding rod 114 in U.S. Pat. No. 7,267,156) inside a top supporter and a fixing rod (such as upper-end support bar 111 in U.S. Pat. No. 7,267,156). A lifting member (such as adjusting cord/lift mechanism 116 in U.S. Pat. No. 7,267,156) is needed to wind up or pull down the blind sheet. Thus their structure is more complicated than the present invention. The present invention has simplified structure, no lifting member, and easy adjustment of the opacity.

In use, the blind of the present invention is not limited to be used independently. The blind 1 with a looped blind sheet 14 of the present invention can be designed into a whole blind according to the length of the doors/windows, as shown from FIG. 1 to FIG. 11. Or the blind 1 is used in combination with a non-looped blind sheet such as a panel to form a complex blind, as shown from FIG. 12 to FIG. 17A. Only a part of the complex blind is formed by the blind 1 with a looped blind sheet 14 of the present invention for users to adjust the opacity while other part is formed by at least one panel (non-looped blind sheet) without opacity adjustment.

Figure 12:
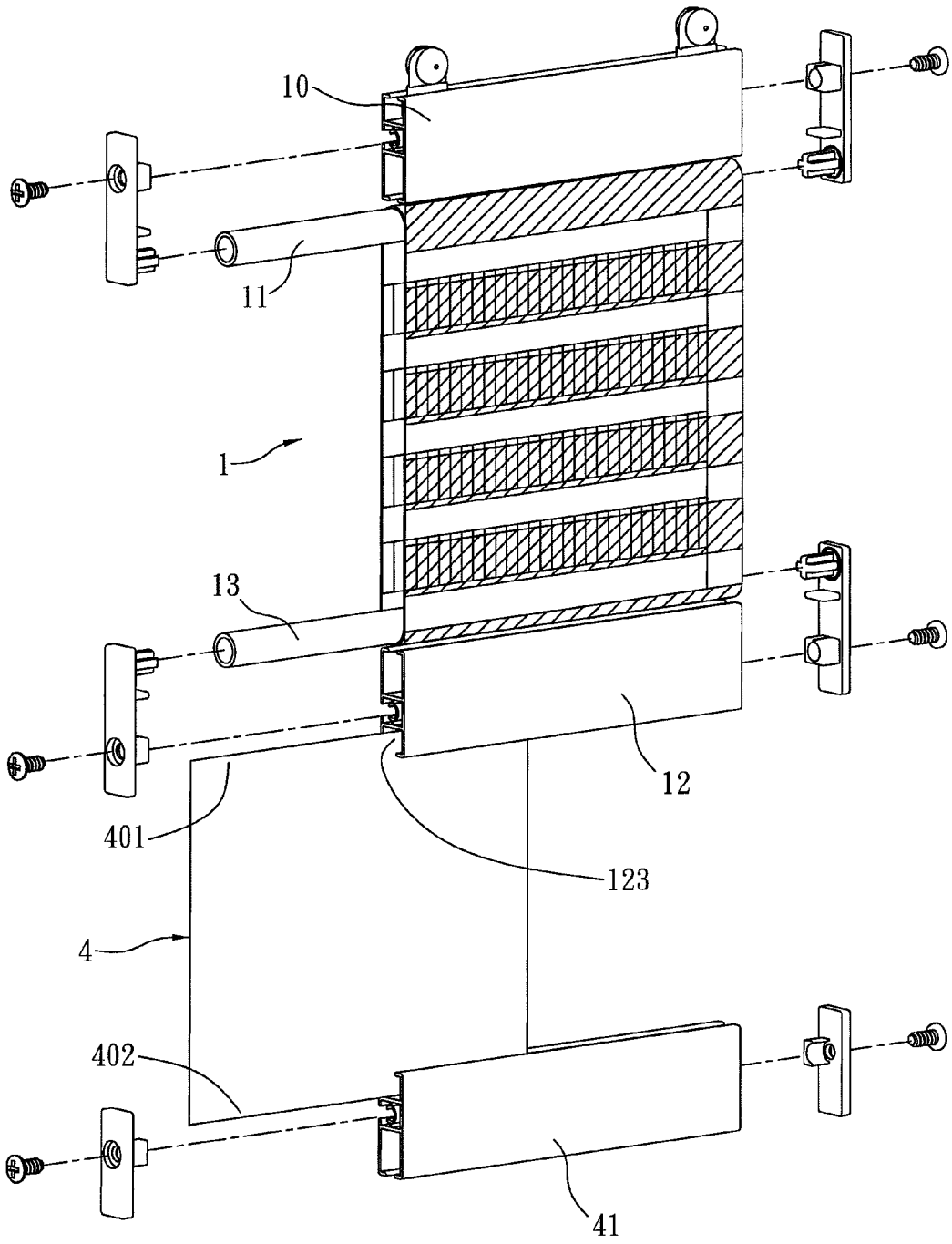
FIG. 12 is an explosive view of the an embodiment having a non-looped blind sheet such as a panel under a bottom rod supporter according to the present invention.
Figure 13:
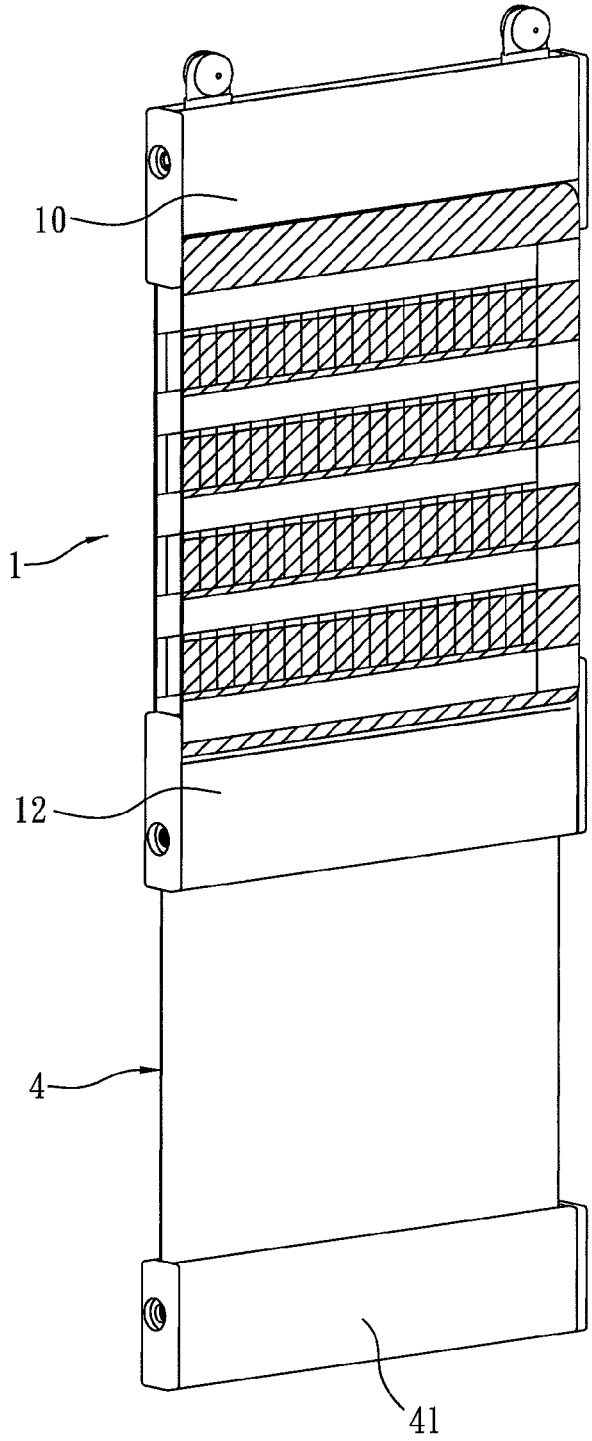
FIG. 13 is an assembly view of the embodiment in FIG. 12.
Figure 13A:
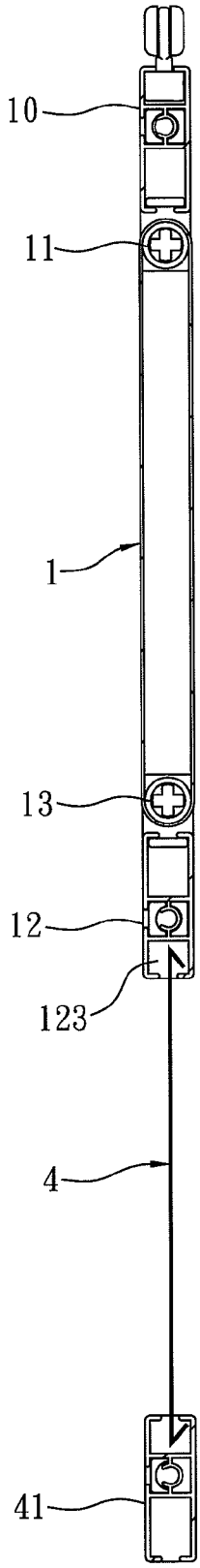
FIG. 13A is a cross sectional view of the embodiment in FIG. 13.

Refer from FIG. 12 to FIG. 13A, a complex blind includes a blind 1 with a looped blind sheet 14 for adjusting opacity on an upper part and a non-looped blind sheet such as a panel 4 on a lower part. In use, a panel 1 is connected to a bottom of the bottom rod supporter 12. The lower part of the bottom rod supporter 12 extends to form a groove 123 with an opening facing downward for mounting a non-looped blind sheet such as a panel 4 with the same width of the looped blind sheet 14. A top surface 401 of the panel 4 can be mounted into the groove 123 on the bottom of the bottom rod supporter 12 by clipping or other ways, but not limited to. Thus a complex blind including the blind 1 with the looped blind sheet for adjusting opacity and the common panel 4 is formed. This design can increase the total length of the blind by the panel extending downward. Thus the length of the complex blind can be adjusted easily according to the length of the doors or windows. This is convenient for do-it-yourself users.

Figure 14:
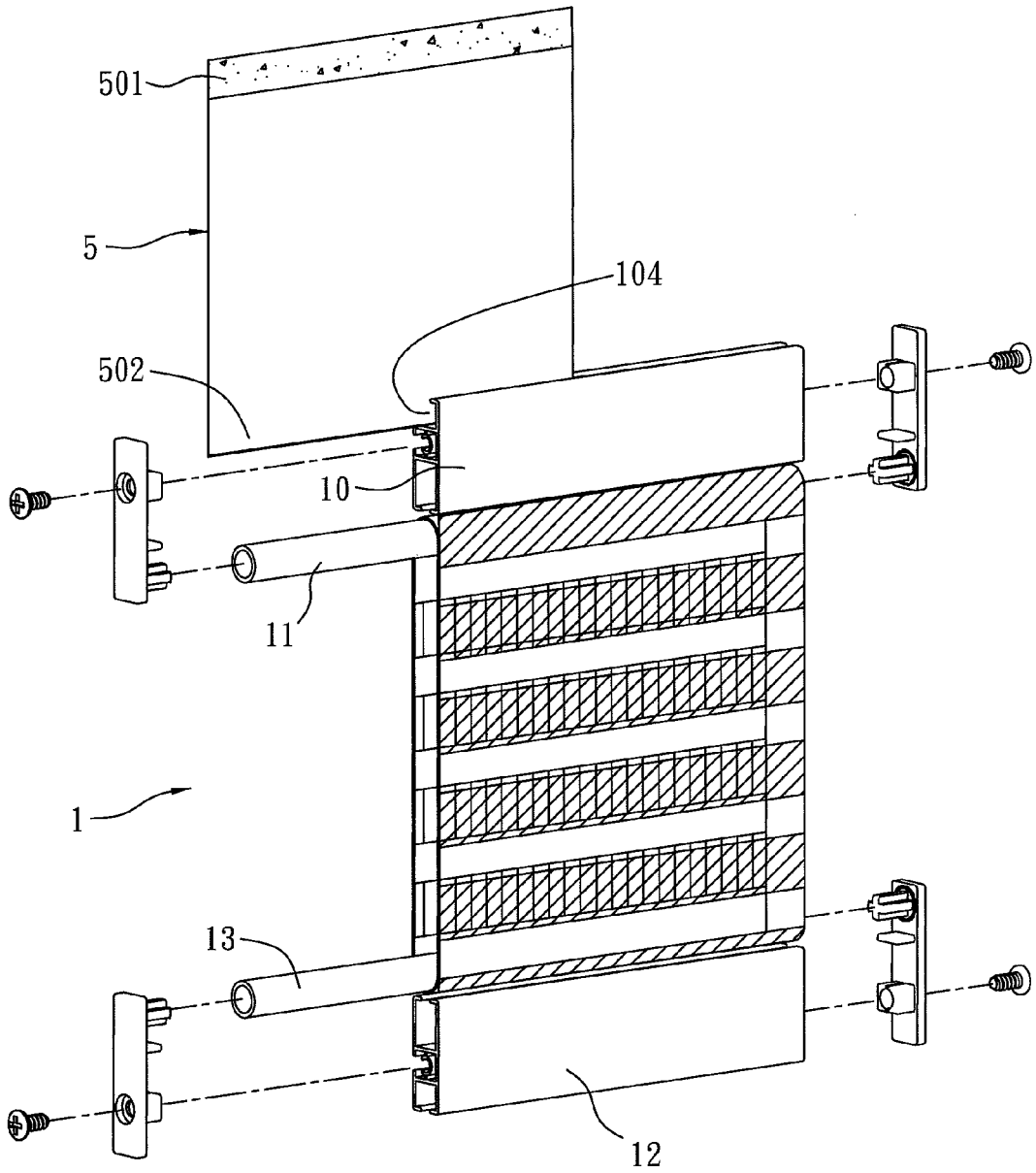
FIG. 14 is an explosive view of the an embodiment having a non-looped blind sheet such as a panel over a top rod supporter according to the present invention.
Figure 15:
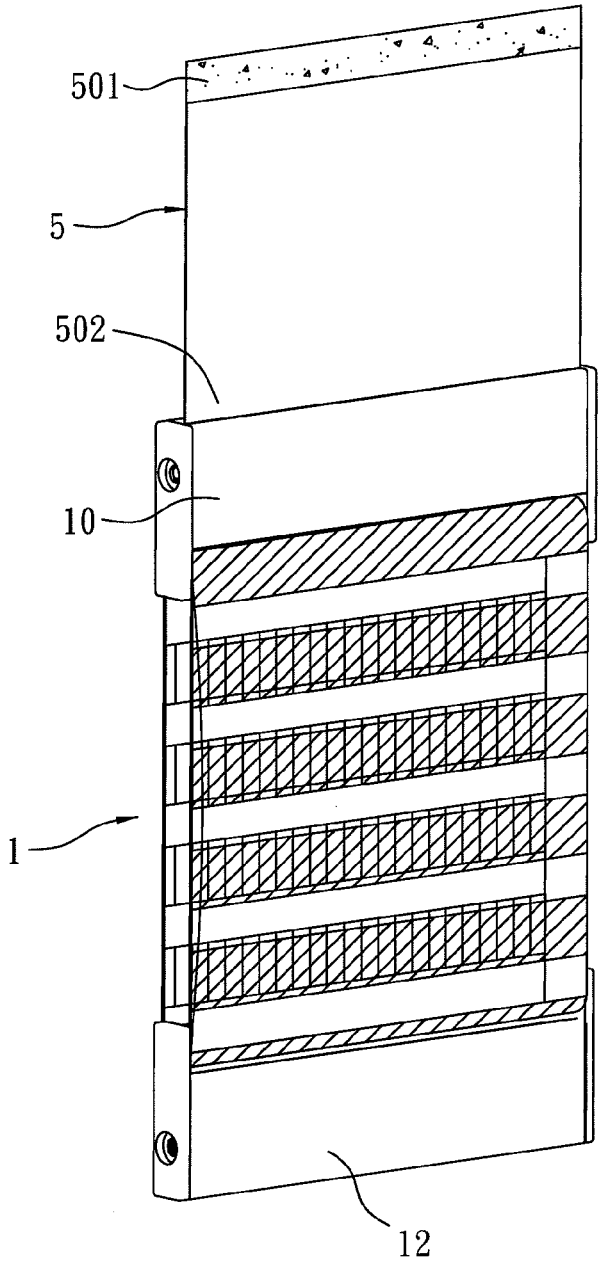
FIG. 15 is an assembly view of the embodiment in FIG. 14.
Figure 15A:
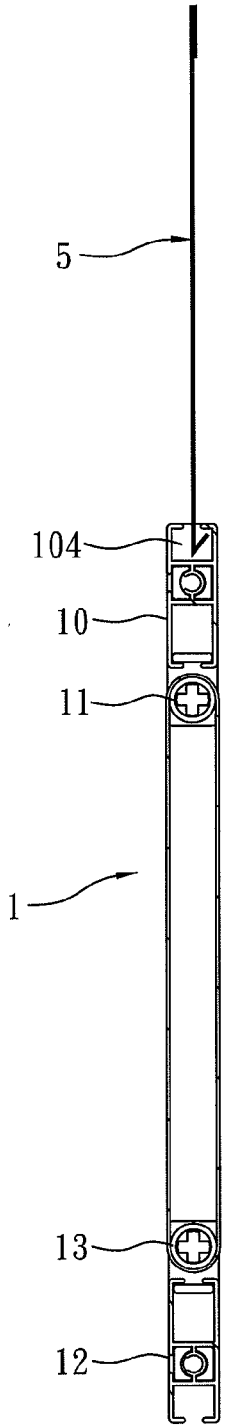
FIG. 15A is a cross sectional view of the embodiment in FIG. 15.

Refer to FIG. 14, FIG. 15, and FIG. 15A, a further embodiment is revealed. This embodiment includes a blind 1 with a looped blind sheet 14 for adjusting opacity on a lower part and a non-looped blind sheet such as a panel 5 on an upper part. In use, a panel 5 is connected to a bottom of the bottom rod supporter 12. The upper part of the top rod supporter 10 extends to form a groove 104 with an opening facing upward so as to mount the panel 5 (non-looped blind sheet) with the same width of the looped blind sheet 14. A top surface 501 of the panel 5 is disposed and fixed on, but not limited to, a carrier track of a sliding panel. Generally, an adhesion surface formed by Velcro or double-sided tape is arranged at the top surface 501 for easy assembling. A bottom surface 502 of the panel 5 can be mounted into the groove 104 on the bottom of the bottom rod supporter 12 by clipping or other ways, but not limited to. Thus a complex blind including the blind 1 with the looped blind sheet for adjusting opacity and the panel 5 is formed. This design enables the blind 1 with the looped blind sheet 14 to be used in combination with carrier tracks of general sliding panels more easily and conveniently.

Figure 16:
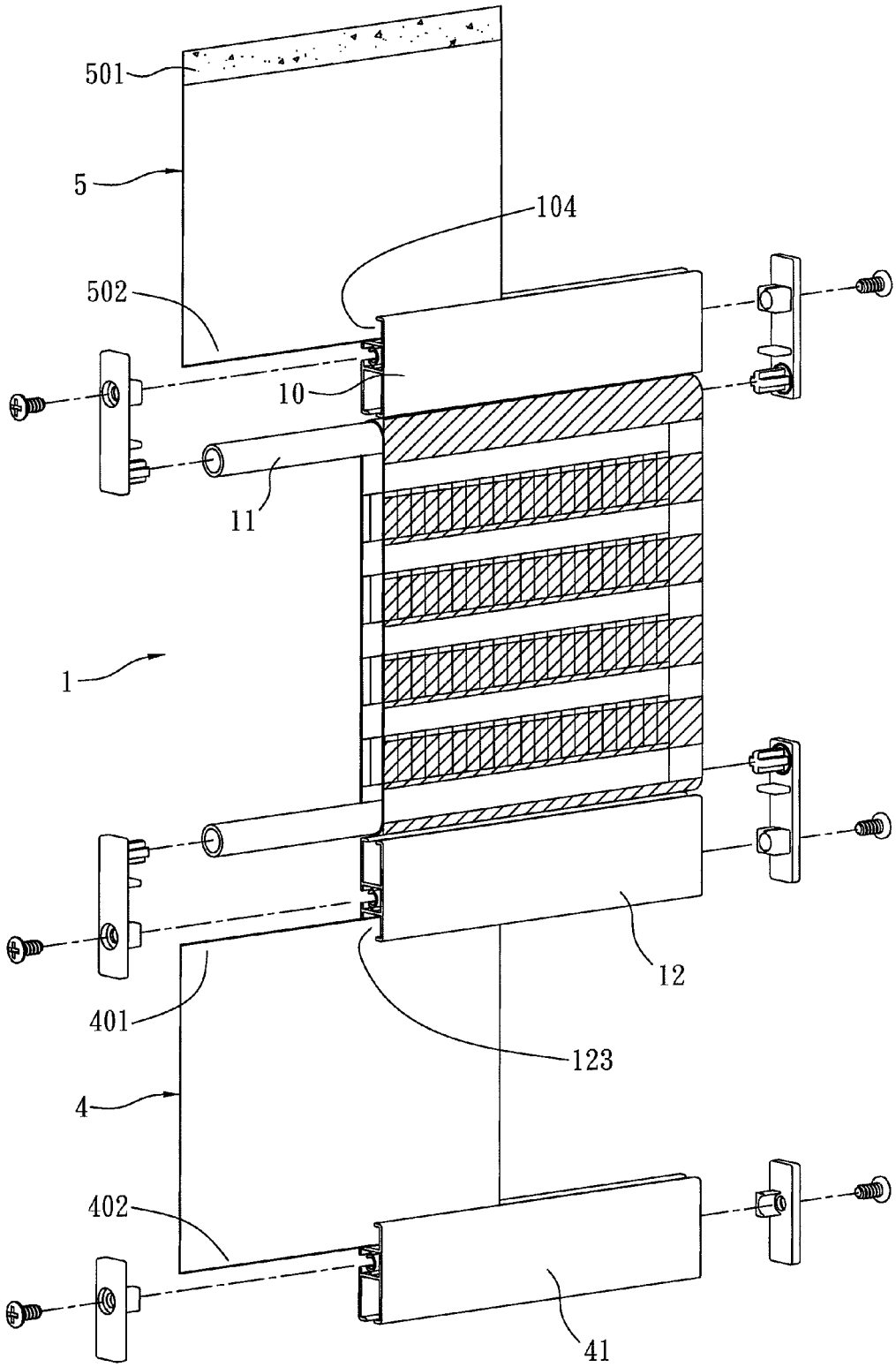
FIG. 16 is an explosive view of the an embodiment having a non-looped blind sheet such as a panel under a bottom rod supporter and over a top rod supporter respectively according to the present invention.
Figure 17:
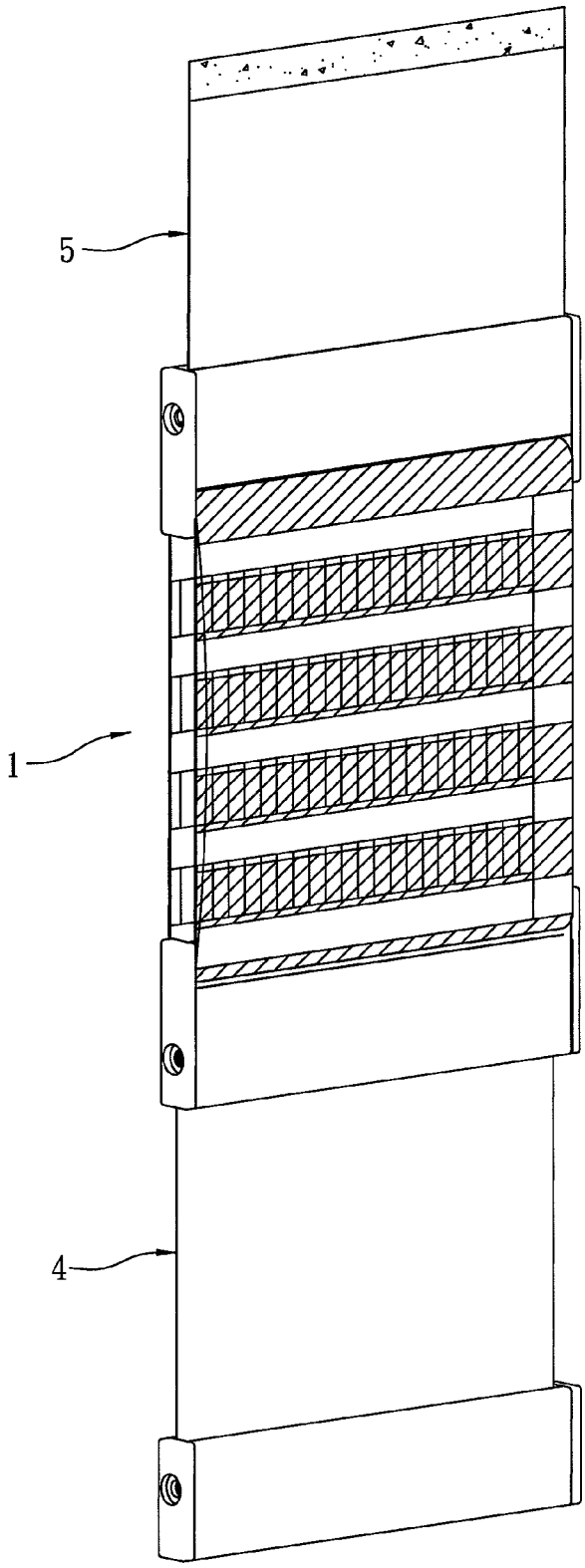
FIG. 17 is an assembly view of the embodiment in FIG. 16.
Figure 17A:
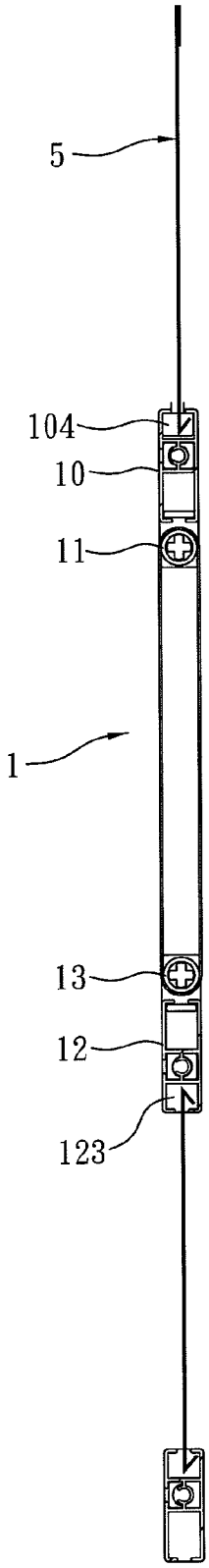
FIG. 17A is a cross sectional view of the embodiment in FIG. 17.

Refer to FIG. 16, FIG. 17 and FIG. 17A, a further embodiment is disclosed. This embodiment includes a blind 1 with a looped blind sheet 14 for adjusting opacity on a middle part, a non-looped blind sheet such as a panel 4, 5 on both a lower part and an upper part respectively. A complex blind of this embodiment can be seen as a combination of the embodiment shown in FIG. 12-13A and the embodiment shown in FIG. 14-15A.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A blind with a looped blind sheet for adjusting opacity comprising:

a top rod supporter;

a top rod whose left and right ends connected to the top rod supporter;

a bottom rod supporter;

a bottom rod whose left and right ends connected to the bottom rod supporter; and a looped blind sheet with predetermined length and width having see-through parts and opaque parts arranged in an alternate manner and connected to form a loop; the loop wound between the top rod and the bottom rod to form a front blind sheet and a rear blind sheet that are opposed to each other and are stretched tightly by weight of both the bottom rod and the bottom rod supporter;

wherein overlap degree of the see-through parts and the opaque parts between the front blind sheet and the rear blind sheet is changed by synchronous relative movement of the front blind sheet and the rear blind sheet when the front blind sheet or the rear blind sheet is pulled down or up so as to adjust opacity of the blind without changing length of the front blind sheet and length of the rear blind sheet, and wherein a small loop with certain length is formed on a bight of the looped blind sheet around the top rod or the bottom rod; the small loop including a front termination and a rear termination while the top rod or the bottom rod passes through in the small loop so as to limit relative movement of the front and the rear blind sheets being pulled for adjusting opacity.

2. The device as claimed in claim 1, wherein the left and right ends of the top rod are rotatably connected with the top rod supporter.

3. The device as claimed in claim 1, wherein the left and right ends of the bottom rod are rotatably connected with the bottom rod supporter.

4. The device as claimed in claim 1, wherein the top rod supporter is in a form of a carrier track of a sliding panel.

5. The device as claimed in claim 1, wherein the top rod supporter is disposed with a hook for being hooked onto a curtain rod.

6. The device as claimed in claim 1, wherein the length of the small loop is set as a basic displacement unit of the front and the rear blind sheets during opacity adjustment so that the opaque parts of the front blind sheet correspond to and overlap with the see-through parts of the rear blind sheet so as to form the shade state when the top rod is stopped at a termination of the small loop; while the top rod or the bottom rod being stopped at the other termination of the small loop, the see-through parts of the front blind sheet correspond to and overlap with the see-through parts of the rear blind sheet so that the see-through state is formed; the opacity adjustment of the blind is achieved by pulling the front blind sheet or the rear blind sheet up or down a certain length.

7. The device as claimed in claim 1, wherein the blind is a complex blind further includes at least one panel that is a non-looped blind sheet with the same width of the looped blind sheet.

8. The device as claimed in claim 7, wherein the looped blind sheet is on an upper part of the complex blind while the panel with the same width of the looped blind sheet is on a lower part of the complex blind.

9. The device as claimed in claim 7, wherein the looped blind sheet is on a lower part of the complex blind while the panel with the same width of the looped blind sheet is on an upper part of the complex blind.

10. A blind with a looped blind sheet for adjusting opacity comprising:

a top rod supporter;

a top rod whose left and right ends connected to the top rod supporter;

a bottom rod supporter;

a bottom rod whose left and right ends connected to the bottom rod supporter; and a looped blind sheet with predetermined length and width having see-through parts and opaque parts arranged in an alternate manner and connected to form a loop; the loop wound between the top rod and the bottom rod to form a front blind sheet and a rear blind sheet that are opposed to each other and are stretched tightly by weight of both the bottom rod and the bottom rod supporter;

wherein overlap degree of the see-through parts and the opaque parts between the front blind sheet and the rear blind sheet is changed by synchronous relative movement of the front blind sheet and the rear blind sheet when the front blind sheet or the rear blind sheet is pulled down or up so as to adjust opacity of the blind without changing length of the front blind sheet and length of the rear blind sheet, and wherein the looped blind sheet further includes a front stop point and a rear stop point on a bight of the top rod or the bottom rod so as to limit displacement of the front and the rear blind sheets being pulled for adjusting opacity.

11. The device as claimed in claim 10, wherein a distance between the front stop point and the rear stop point is set as a basic displacement unit of the front blind sheet and the rear blind sheet during opacity adjustment; the see-through parts of the front blind sheet correspond to and overlap with the see-through parts of the rear blind sheet so as to be in the see-through state when the top rod or the bottom rod is stopped at one stop point while the opaque parts of the front blind sheet correspond to and overlap with the see-through parts of the rear blind sheet so that the blind is in the shade state when the top rod or the bottom rod is stopped at the other stop point; by the front blind sheet or the rear blind sheet being pulled up or down a certain distance, the opacity adjustment of the blind is achieved.

12. A blind with a looped blind sheet for adjusting opacity comprising:

a top rod supporter;

a top rod whose left and right ends connected to the top rod supporter;

a bottom rod supporter;

a bottom rod whose left and right ends connected to the bottom rod supporter; and a looped blind sheet with predetermined length and width having see-through parts and opaque parts arranged in an alternate manner and connected to form a loop; the loop wound between the top rod and the bottom rod to form a front blind sheet and a rear blind sheet that are opposed to each other and are stretched tightly by weight of both the bottom rod and the bottom rod supporter;

wherein overlap degree of the see-through parts and the opaque parts between the front blind sheet and the rear blind, sheet is changed by synchronous relative movement of the front blind sheet and the rear blind sheet when the front blind sheet or the rear blind sheet is pulled down or up so as to adjust opacity of the blind without changing length of the front blind sheet and length of the rear blind sheet, wherein the blind is a complex blind further includes at least one panel that is a non-looped blind sheet with the same width of the looped blind sheet, wherein the looped blind sheet is on an upper part of the complex blind while the panel with the same width of the looped blind sheet is on a lower part of the complex blind, and wherein a lower part of the bottom rod supporter extends to form a groove with an opening facing downward so as to mount a top surface of the panel with the same width of the looped blind.

13. A blind with a looped blind sheet for adjusting opacity comprising:

a top rod supporter;

a top rod whose left and right ends connected to the top rod supporter;

a bottom rod supporter a bottom rod whose left and right ends connected to the bottom rod supporter; and a looped blind sheet with predetermined length and width having see-through parts and opaque parts arranged in an alternate manner and connected to form a loop; the loop wound between the top rod and the bottom rod to form a front blind sheet and a rear blind sheet that are opposed to each other and are stretched tightly by weight of both the bottom rod and the bottom rod supporter;

wherein overlap degree of the see-through parts and the opaque parts between the front blind sheet and the rear blind sheet is changed by synchronous relative movement of the front blind sheet and the rear blind sheet when the front blind sheet or the rear blind sheet is pulled down or up so as to adjust opacity of the blind without changing length of the front blind sheet and length of the rear blind sheet, wherein the blind is a complex blind further includes at least one panel that is a non-looped blind sheet with the same width of the looped blind sheet, wherein the looped blind sheet is on a lower part of the complex blind while the panel with the same width of the looped blind sheet is on an upper part of the complex blind, and wherein an upper part of the top rod supporter extends to form a groove with an opening facing upward so as to mount a bottom surface of the panel with the same width of the looped blind sheet.

* * * * *